US012319526B2

(12) United States Patent
Lopes et al.

(10) Patent No.: US 12,319,526 B2
(45) Date of Patent: Jun. 3, 2025

(54) HORIZONTAL FORMING DEVICE

(71) Applicant: SYNTEGON PACKAGING SYSTEMS AG, Beringen (CH)

(72) Inventors: Michael Lopes, Stockach (DE); Maurizio Maj, Winterthur (CH); Thomas Peter, Kloten (CH); Kai Brombach, Bonndorf (DE)

(73) Assignee: SYNTEGON PACKAGING SYSTEMS AG, Beringen (CH)

( * ) Notice: Subject to any disclaimer, the term of this patent is extended or adjusted under 35 U.S.C. 154(b) by 374 days.

(21) Appl. No.: 17/781,807

(22) PCT Filed: Nov. 30, 2020

(86) PCT No.: PCT/EP2020/083974

§ 371 (c)(1),
(2) Date: Jun. 2, 2022

(87) PCT Pub. No.: WO2021/110604

PCT Pub. Date: Jun. 10, 2021

(65) Prior Publication Data

US 2023/0174332 A1 Jun. 8, 2023

(30) Foreign Application Priority Data

Dec. 3, 2019 (DE) ..... 10 2019 132 878.0

(51) Int. Cl.

| | |
|---|---|
| ***B65H 18/08*** | (2006.01) |
| ***B65B 9/06*** | (2012.01) |
| ***B65B 61/00*** | (2006.01) |

(52) U.S. Cl.

CPC ..... *B65H 18/08* (2013.01); *B65B 9/06* (2013.01); *B65B 61/00* (2013.01); *B65B 2009/063* (2013.01)

(58) Field of Classification Search

CPC ..... B65B 9/06; B65B 2009/063; B65B 9/067; B65B 9/22; B65B 59/001; B65B 9/10;

(Continued)

(56) References Cited

U.S. PATENT DOCUMENTS

| | | | |
|---|---|---|---|
| 4,520,615 | A | 6/1985 | Engler et al. |
| 5,235,792 | A | 8/1993 | Hanagata |

(Continued)

FOREIGN PATENT DOCUMENTS

| | | | |
|---|---|---|---|
| CN | 1369407 | A | 9/2002 |
| CN | 101177171 | A | 5/2008 |

(Continued)

OTHER PUBLICATIONS

Mizuguchi, Machine Translation of JP 3002771 B2, Jan. 2000 (Year: 2024).*

(Continued)

*Primary Examiner* — Veronica Martin

(74) *Attorney, Agent, or Firm* — Michael Best & Friedrich LLP

(57) ABSTRACT

A horizontal forming device, in particular for horizontal flow pack machines, comprises at least one, in particular roller-free, forming unit (12*a*12*d*), in particular a forming shoulder, which is configured for forming a packaging material web (14*a*), in particular a paper web, into a packaging material tube (16*a*), the forming unit (12*a*-12*d*) comprising at least one folding edge (72*a*-72*d*) around which the packaging material web (14*a*) is deflectable, and comprises at least one form-guiding unit (18*a*-18*d*), in particular a further forming shoulder, which is configured for further guiding the packaging material tube (16*a*) transversely to a run-in direction (20*a*20*d*) of the packaging material web (14*a*) at the forming unit (12*a*-12*d*) while maintaining an, in particular homogeneous, material tension generated by the forming unit (12*a*12*d*), (Continued)

wherein the horizontal forming device comprises at least one support surface (22*a*), in particular a work plate, on which products (24*a*) that are to be packaged can be transported, the forming unit (12*a*-12*d*) and the form-guiding unit (18*a*-18*d*) being arranged on sides (26*a*-26*d*, 28*a*-28*d*) of the support surface (22*a*) that face away from each other, wherein the form-guiding unit (18*a*-18*d*) comprises at least one form-guiding contour (86*a*-86*d*), which is configured to support the guided packaging material tube (16*a*) in order to implement a maintaining of the homogeneous material tension.

20 Claims, 7 Drawing Sheets

(58) Field of Classification Search
CPC ..... B65B 9/20; B65B 63/02; B65B 25/146; B65B 9/073
See application file for complete search history.

(56) References Cited

U.S. PATENT DOCUMENTS

| | | | | | |
|---|---|---|---|---|---|
| 5,255,495 | A * | 10/1993 | Kovacs | B65B 59/001 53/550 |
| 5,799,470 | A * | 9/1998 | Sautter | B65B 9/06 53/550 |
| 2002/0194816 | A1* | 12/2002 | Schneider | B65B 65/06 53/550 |
| 2011/0256998 | A1* | 10/2011 | Tanner | B65B 9/06 493/269 |

FOREIGN PATENT DOCUMENTS

| | | | |
|---|---|---|---|
| CN | 104309842 | A | 1/2015 |
| CN | 105857668 | A | 8/2016 |
| CN | 109353596 | A | 2/2019 |
| DE | 1586334 | B1 | 3/1972 |
| EP | 1364876 | A1 | 11/2003 |
| JP | S53131914 | U | 10/1978 |
| JP | S5452462 | U | 4/1979 |
| JP | S55143494 | U | 10/1980 |
| JP | H06312710 | A | 11/1994 |
| JP | H08119209 | A | 5/1996 |
| JP | H1016906 | A | 1/1998 |
| JP | 3002771 | B2 * | 1/2000 |
| JP | 2005228871 | A | 8/2005 |

OTHER PUBLICATIONS

Translation of International Search Report for Application No. PCT/EP2020/083974 dated Feb. 18, 2021 (2 pages).

German Patent Office Search Report for Application No. 102019137878 dated Apr. 29, 2020 (15 pages including English translation).

Japanese Patent Office Action for Application No. 2022-533353 dated Mar. 27, 2023 (5 pages, English translation included).

Chinese Patent Office Action for Related Application No. 202080083281.5 dated Feb. 11, 2023 (10 pages, including an English summary).

* cited by examiner

HORIZONTAL FORMING DEVICE

CROSS REFERENCE TO RELATED APPLICATION

This application is based on and incorporates herein by reference PCT patent application PCT/EP2020/083974 filed on Nov. 30, 2020 and German patent application DE 10 2019 132 878.0 filed on Dec. 3, 2019.

Horizontal forming devices are already known from U.S. Pat. No. 5,235,792 A and from JP H10-16906 A, with at least one forming unit which is configured for forming a packaging material web into a packaging material tube, and with at least one form-guiding unit which is configured for further guiding the packaging material tube transversely to a run-in direction of the packaging material web at the forming unit while maintaining a material tension generated by the forming unit.

Furthermore, horizontal forming devices are also known from EP 1 364 876 A1, JP H06-312 710 A und U.S. Pat. No. 4,520,615 A.

SUMMARY

The invention is based on a horizontal forming device, in particular for horizontal flow pack machines, with at least one, in particular roller-free, forming unit, in particular a forming shoulder, which is configured for forming a packaging material web, in particular a paper web, into a packaging material tube, the forming unit comprising at least one folding edge around which the packaging material web is deflectable, and with at least one form-guiding unit, in particular a further forming shoulder, which is configured for further guiding the packaging material tube transversely to a run-in direction of the packaging material web at the forming unit while maintaining an, in particular homogeneous, material tension generated by the forming unit.

It is proposed that the horizontal forming device comprises at least one support surface, in particular a work plate, on which products that are to be packaged can be transported, the forming unit and the form-guiding unit being arranged on sides of the support surface that face away from each other, wherein the form-guiding unit comprises at least one form-guiding contour which is configured to support the guided packaging material tube in order to implement a maintaining of the homogeneous material tension.

Preferably a packaging machine, in particular a horizontal flow pack machine, comprises the horizontal forming device. In particular, the horizontal forming device is configured for guiding a packaging material, in particular the packaging material tube, along a horizontal transport direction, in particular along a transport direction running at least substantially perpendicularly to an effective gravity force direction. The term "substantially perpendicularly" is in particular meant to define an orientation of a direction relative to a reference direction, wherein the direction and the reference direction, in particular viewed in a projection plane, include a 90°-angle, the angle having a maximum deviation that is in particular smaller than 8°, advantageously smaller than 5° and especially advantageously smaller than 2°. "Configured" is in particular to mean specifically programmed, specifically designed and/or specifically equipped. By an object being configured for a certain function is in particular to be understood that the object fulfills and/or executes this certain function in at last one application state and/or operation state.

Preferably the horizontal forming device is configured at least for a forming and/or guiding of a packaging material web, the packaging material being preferentially realized as a paper material. In particular, the packaging material web is embodied as a paper web. The horizontal forming device may preferably be configured, additionally or at least alternatively, for a forming and/or guiding of a packaging material web wherein the packaging material is realized differently than a paper material, for example as a synthetic material. In particular, the packaging material web may alternatively be made of a synthetic material. The packaging material is in particular configured for a packaging, in particular an enveloping, of products, in particular food products. The packaging material is preferentially embodied as a packaging paper. A "packaging material web" is in particular to mean a planar, in particular two-dimensional, configuration of the packaging material, in particular of the packaging paper. Preferably the packaging machine comprises at least one packaging material wind-off unit, which is configured to accommodate the packaging material, in particular as a packaging material roll. Preferably the packaging material wind-off unit is configured for unwinding the packaging material as a packaging material web, in particular to feed the packaging material to a packaging material feeding unit of the packaging machine. The packaging material feeding unit is in particular configured to feed the packaging material web to the horizontal forming device, in particular to the forming unit. The packaging material feeding unit may comprise a plurality of components, in particular components known to someone skilled in the art, like for example at least one oscillating lever, at least one centering feeler, at least one web edge guide control and/or at least one printing unit for printing the packaging material.

A "packaging material tube" is in particular to mean a re-formed, in particular three-dimensional, configuration of the packaging material, in particular of the packaging paper, which is in particular re-formed at least transversely to a web plane of the packaging material web. In particular, the packaging material tube is configured to envelope products that are to be packaged. In particular, the packaging machine comprises at least one product feeding unit, in particular a conveyor belt, a driver chain or the like, which is configured to transport the products that are to be packaged, for an enveloping by the packaging material tube, into a region of the horizontal forming device, in particular of the forming unit. Preferably a transport direction of the products runs at least substantially parallel to a transport direction of the packaging material tube. "Substantially parallel" is in particular to mean an orientation of a direction relative to a reference direction, in particular in a plane, wherein the direction has a deviation from the reference direction that is in particular smaller than 8°, advantageously smaller than 5° and especially advantageously smaller than 2°. Preferably the product feeding unit is arranged along the transport direction of the packaging material tube upstream of the horizontal forming device, in particular of the forming unit.

Preferably the packaging machine comprises at least one longitudinal sealing unit which is configured to create—in particular via a heat input into the packaging material and/or by pressure onto the packaging material—a longitudinal sealing seam of the packaging material tube, running in particular at least substantially parallel to the transport direction of the packaging material tube. The longitudinal sealing unit is arranged along the transport direction of the packaging material tube downstream of the horizontal forming device, in particular of the form-guiding unit. In particular, the longitudinal sealing unit comprises at least one pair of sealing rollers, which are in particular provided with a profile, and/or can be subjected to pressure and/or are heatable, and which are configured to transport the packaging material tube, in particular via rotation. Preferably the longitudinal sealing unit comprises a plurality of pairs of sealing rollers, wherein at least a first pair of sealing rollers, which is arranged along the transport direction of the packaging material tube downstream of the horizontal forming device, is implemented so as to be free of heating, in particular for a heating-free transport of the packaging material tube. Preferably the packaging machine comprises at least one transversal sealing unit which is configured, in particular in each case after a respective product, to create—in particular via selective pressure onto the packaging material and/or by a heat input into the packaging material—transversal sealing seams of the packaging material tube, which in particular extend at least substantially perpendicularly to the transport direction of the packaging material tube. In particular, the transversal sealing unit is configured for singulating the packaging material tube into individual packagings, which in particular in each case enclose one product. The transversal sealing unit is arranged along the transport direction of the packaging material tube downstream of the longitudinal sealing unit.

The forming unit is preferably configured for a deflection of the packaging material web. In particular, the packaging material feeding unit is configured to feed the packaging material web to the forming unit along a direction that runs transversely, in particular at least substantially perpendicularly, to the transport direction of the packaging material tube. The forming unit preferably has at least one folding edge around which the packaging material web is deflectable. Preferentially, the folding edge is embodied as a shoulder edge and the forming unit is embodied as a forming shoulder. In particular, the forming unit is realized free of rollers for a deflection of the packaging material web. Preferably the forming unit is configured to deflect the packaging material web at the folding edge in a direction that is transverse to the run-in direction of the packaging material web and transverse to the transport direction of the packaging material tube. In particular, the folding edge extends at least substantially perpendicularly to the run-in direction of the packaging material web and to the transport direction of the packaging material tube. In particular, the folding edge is configured to generate a homogeneous material tension in the packaging material. The forming unit preferably comprises at least two form-contour edges which extend, starting from the folding edge, transversely to the folding edge, in particular in a V-shape. In particular, the packaging material web can be re-formed at the form-contour edges so as to form the packaging material web. Preferably the form-contour edges extend along a running direction of the packaging material and/or along an outer contour of the fed-in products from the folding edge to a forming tunnel of the forming unit that is configured to guide the packaging material tube along the transport direction of the packaging material tube. In particular, a longitudinal axis of the forming tunnel runs at least substantially parallel to the transport direction of the packaging material tube.

The form-guiding unit is preferentially configured for further guiding the packaging material tube at least substantially perpendicularly to the run-in direction of the packaging material web at the forming unit, in particular along the transport direction of the packaging material tube, while maintaining the homogeneous material tension generated by the forming unit, in particular by the folding edge. In particular, the form-guiding unit is arranged along the transport direction of the packaging material tube downstream of the forming unit, and in particular upstream of the longitudinal sealing unit. Preferably the form-guiding unit comprises at least one, in particular three-dimensional, form-guiding contour, which is configured to support the guided packaging material tube, in particular at least an outer edge of the packaging material tube, in particular for an implementation of a maintaining of the homogeneous material tension. Preferably the form-guiding unit comprises at least two form-guiding contours, which are in particular arranged mirror-symmetrically with respect to an imaginary symmetry plane extending at least substantially parallel to the transport direction of the packaging material tube, in which in particular the transport direction of the packaging material runs and which extends at least substantially perpendicularly to the folding edge of the forming unit. Preferably the form-guiding unit is implemented mirror-symmetrically, in particular with respect to the imaginary symmetry plane. It is alternatively conceivable that the form-guiding unit and/or the forming unit are/is implemented in an asymmetrical fashion. Preferably the form-guiding unit is realized free of rollers for a deflection of the packaging material tube, in particular as a further forming shoulder. In particular, the form-guiding unit may have a geometry that is at least substantially analogous to a geometry of the forming unit.

The support surface preferably forms a cargo track which the products can be transported on. The support surface preferably extends at least substantially parallel to the transport direction of the packaging material tube. Preferably the product feeding unit, the longitudinal sealing unit, in particular the sealing rollers, and/or the transversal sealing unit are/is arranged at least section-wise within the support surface, extending at least section wise through the support surface. In particular, rotation axes of the sealing rollers of the longitudinal sealing unit extend at least substantially perpendicularly to the support surface. Preferably the forming unit is arranged on a side of the support surface on which the products can be transported and on which in particular the packaging material wind-off unit and the packaging material feeding unit are arranged. The form-guiding unit is preferably arranged on a further side of the support surface, on which in particular the longitudinal sealing unit is arranged—at least to a large extent, in particular by more than 50% of a maximum extension of the longitudinal sealing unit—at least substantially parallel to the rotation axes of the sealing rollers. In particular, the form-guiding unit may be coupled at least section-wise with the support surface. In particular, the packaging material tube extends at least section-wise through the support surface, in particular to the further side of the support surface.

An implementation of the horizontal forming device according to the invention advantageously allows the packaging material tube being guided precisely on two sides of the support surface facing away from each other. Advantageously precise re-forming of a packaging material web into a packaging material tube is enabled. Advantageously packaging material webs made of sensitive, in particular tear-prone and/or very thin, materials, which are in particular made of paper, can be re-formed into packaging material tubes. It is advantageously possible to produce at least substantially crease-free packaging tubes. In particular, an advantageously compact horizontal forming device can be provided.

Furthermore, it is proposed that the form-guiding unit is realized, in particular arranged, separately from the forming unit. Preferably the form-guiding unit is realized as an autonomous component or as an autonomous sub-assembly, which is in particular implemented of two symmetrical components. In particular, the form-guiding unit is arranged spaced apart from the forming unit along a direction running at least substantially perpendicular to the transport direction of the packaging material tube, in particular along the run-in direction of the packaging material web, and/or along the transport direction of the packaging material tube. It is alternatively conceivable that the form-guiding unit is realized in a one-part implementation with the forming unit, in particular as a form-guiding projection of the forming unit. "In a one-part implementation" is in particular to mean formed in one piece. Preferably this one piece is made of a single blank, of a mass and/or of a cast, particularly preferentially in an injection-molding procedure, in particular a one-component and/or multi-component injection-molding procedure. Advantageously precise guiding of the packaging material tube is enabled over a large distance.

It is moreover proposed that the horizontal forming device comprises at least one, in particular U-shaped, product and/or packaging material guiding tunnel, which is configured to support the packaging material tube. The product and/or packaging material guiding tunnel may in particular be arranged on the side of the support surface that faces toward the forming unit, and may in particular be fastened on the support surface. The product and/or packaging material guiding tunnel may in particular extend along the transport direction of the packaging material tube at least from upstream of the forming unit as far as the forming unit, preferentially as far as the form-guiding unit and particularly preferentially as far as the first pair of sealing rollers of the longitudinal sealing unit. Preferably the product and/or packaging material guiding tunnel has a cross section that is implemented at least substantially in analogy to a cross section of products to be packaged, in particular a slightly greater cross section than the products to be packaged. In particular, the products are transportable within the product and/or packaging material guiding tunnel. Preferably the forming unit is configured to at least section-wise form the packaging material tube around the product and/or packaging material guiding tunnel, in particular around outer edges of the product and/or packaging material guiding tunnel. In particular, the product and/or packaging material guiding tunnel is configured to support the packaging material tube, in particular in addition to the form-guiding unit. Alternatively, it is conceivable that the horizontal forming device and the packaging machine are embodied free of a product and/or packaging material guiding tunnel. Advantageously precise enclosing of the products is enabled.

It is further proposed that the horizontal forming device comprises at least one adjusting unit which is configured, for an implementation of different packaging material tube geometries, to support the forming unit and the form-guiding unit such that they are adjustable, in particular in different adjustment planes. Preferably the horizontal forming device comprises at least two adjusting units, wherein one adjusting unit is configured to adjustably support the forming unit and wherein a further adjusting unit is configured to adjustably support the form-guiding unit. In particular, for packaging different products different packaging material tube geometries may be required. In particular, the packaging machine is configured for packaging different products, which in particular have different dimensions. In particular, for packaging different products having different maximum extensions at least substantially perpendicularly to the support surface, in particular different heights, and/or having different maximum extensions at least substantially parallel to the support surface and transversally to the transport direction of the packaging material tube, in particular different widths, different packaging material tube geometries may be required. In particular, a maximum extension of the packaging material tube at least substantially perpendicular to the support surface, in particular a height of the packaging material tube, and/or a maximum extension of the packaging material tube at least substantially parallel to the support surface and transversely to the transport direction of the packaging material tube, in particular a width of the packaging material tube, are/is adjustable by an adjustment of the forming unit and/or of the form-guiding unit. In particular, the form-guiding unit may be adjustable via the further adjusting unit for a correction of uneven tension conditions in the packaging material.

Preferably the forming unit is supported so as to be adjustable in at least one adjustment plane extending on the side of the support surface that faces toward the forming unit. Preferably the form-guiding unit is supported so as to be adjustable in at least one further adjustment plane extending on the further side of the support surface that faces toward the form-guiding unit. In particular, the forming unit and/or the form-guiding unit are/is supported so as to be adjustable as an entire component or as an entire sub-assembly. In particular, the forming unit and/or the form-guiding unit are/is adjustable in themselves, in particular individual components of the forming unit relative to one another and/or individual components of the form-guiding unit relative to one another. It is possible to provide a horizontal forming device enabling advantageously format-flexible adaption of a packaging material tube geometry to different products that are to be packaged.

It is also proposed that the at least one adjusting unit, in particular the adjusting units, is/are configured to support the forming unit and the form-guiding unit such that they are adjustable relative to each other. In particular, the adjusting units are configured to support the forming unit and the form-guiding unit such that they are adjustable relative to each other as an entire component or as an entire sub-assembly group. Preferably the adjusting units are configured to support the forming unit and the form-guiding unit such that they are linearly movable and/or pivotably movable. Preferably the adjusting unit is configured, in particular for an adjustment of a height of the packaging material tube, to support the forming unit such that it is at least linearly movable along an adjustment direction running at least substantially perpendicularly to the support surface. Alternatively or additionally, it is conceivable that the adjusting unit is configured to support the forming unit such that it is linearly movable along a further adjustment direction running at least substantially perpendicularly to the adjustment direction and at least substantially parallel to the transport direction of the packaging material tube. Preferably the further adjusting unit is configured to support the form-guiding unit such that it is at least linearly movable along at least one adjustment direction running at least substantially parallel to the support surface, in particular transversely to the transport direction of the packaging material tube. Preferably the adjusting units are realized as manual adjusting units for a manual adjustment of the forming unit and the form-guiding unit, in particular with respect to each other. Alternatively or additionally it is conceivable that at least one of the adjusting units comprises at least one automatic adjusting element, in particular a servomotor, which is configured for an automatic adjustment of the forming unit and/or of the form-guiding unit. Advantageously a positioning of the forming unit and the form-guiding unit with respect to each other, optimized for different products and/or packaging materials, is enabled.

Beyond this it is proposed that the at least one adjusting unit, in particular the adjusting units, is/are configured to support at least two forming legs of the forming unit and/or of the form-guiding unit such that they are adjustable relative to one another. Preferably the forming unit comprises at least two forming legs which are supported such that they are adjustable relative to each other, in particular in a linearly movable and/or pivotably movable manner. In particular, the forming legs of the forming unit are supported so as to be adjustable relative to each other in an at least linearly movable manner, in particular along a direction running at least substantially parallel to the folding edge, in particular to a folding edge running surface. In particular, the forming legs of the forming unit together form the folding edge, in particular the folding edge running surface. In particular, the forming legs of the forming unit are supported so as to be movable towards each other and away from each other, in particular along the direction running at least substantially parallel to the folding edge, in particular the folding edge running surface, in particular for an adjustment of a width of the packaging material tube. In particular, the forming legs of the forming unit together form the forming tunnel of the forming unit. In particular, respectively one forming leg of the forming unit in each case forms at least one form-contour edge of the forming unit. The adjusting unit preferably comprises at least one intermediate element, in particular a plurality of intermediate elements, for filling a space between the two forming legs of the forming unit when moved away from each other, in particular in order to ensure different product widths.

Preferably the form-guiding unit comprises at least two forming legs, which are supported such that they are adjustable relative to each other, in particular in a linearly movable and/or pivotably movable manner. In particular, the further adjusting unit, which is configured for an adjustable support of the form-guiding unit, may be implemented at least substantially in analogy to the adjusting unit, which is configured for an adjustable support of the forming unit. Preferably the forming legs of the form-guiding unit are supported so as to be adjustable relative to each other in an at least linearly movable manner. In particular, the further adjusting unit is configured for an adjustable support of the forming legs of the form-guiding unit such that they are linearly movable along different adjustment directions, which in particular run transversely to one another, in particular in order to ensure different product widths. Preferably the adjustment directions run in a shared plane, which in particular extends at least substantially parallel to the support surface, and in particular include identical angles with the transport direction of the packaging material tube. Alternatively or additionally, the forming legs of the form-guiding unit may be supported adjustably relative to each other such that they are at least pivotable, in particular in a pivot plane extending at least substantially parallel to the support surface, in particular for an adjustment of a width of the packaging material tube. In particular, the forming legs of the form-guiding unit may be supported so as to be pivotably movable at an end region of the forming legs of the form-guiding unit that faces away from the forming unit along the transport direction of the packaging material tube. Preferably the end region of the forming legs of the form-guiding unit may be realized, in particular mounted, separately from a remaining region of the form-guiding unit, in particular separately from the remaining region along a separating cut. In particular, in each case a forming leg of the form-guiding unit forms at least one form-guiding contour of the form-guiding unit respectively. Preferably the forming legs of the form-guiding unit are arranged, in particular supported, mirror-symmetrically to each other around the imaginary mirror plane. Advantageously a positioning of forming legs of the forming unit and/or of the form-guiding unit relative to one another is enabled, optimized for different products and/or packaging materials.

Furthermore it is proposed that the forming legs of the form-guiding unit form a guiding region, which tapers in a V-shape in the transport direction of the packaging material tube and is configured to bring seam regions of the packaging material tube together which are to be sealed with each other. In particular, the guiding region is configured to bring longitudinal-sealing seam regions of the packaging material tube together which are to be sealed with each other. In particular, the forming legs of the form-guiding unit have in an end region facing toward the forming unit a greater distance from each other, along a direction running at least substantially parallel to the support surface and at least substantially perpendicularly to the transport direction of the packaging material tube, than in the end region facing away from the forming unit. The seam regions of the packaging material tube are in particular regions in which the packaging material, in particular the packaging paper, is sealed, in particular for creating a sealing seam. In particular, the guiding region is configured to bring the seam regions together in such a way that for a sealing the seam regions are transportable, while adjacent to each other, between and through respectively two sealing rollers of the pairs of sealing rollers. Preferably the guiding region ends, in the end region facing away from the forming unit, in a support contour that is formed by the forming legs of the form-guiding unit and is configured to support the packaging material tube, in particular the seam regions that have been brought together, in particular during a further transport to the longitudinal sealing unit. Advantageously a precise orientation of the seam regions is enabled for an implementation of a neat sealing seam, in particular longitudinal sealing seam.

It is also proposed that the horizontal forming device comprises at least one heating unit, which is configured to at least section-wise heat the forming unit and/or the form-guiding unit, in particular for a heat input into a seam region, in particular the aforementioned seam region. In particular, the heating unit is configured to enable a heat input into the packaging material, in particular the packaging paper, upstream of a sealing, in particular a longitudinal sealing, of the packaging material, in particular the packaging paper. It is alternatively or additionally conceivable that the heating unit is configured to seal the packaging material, in particular the packaging paper, in particular at the form-guiding unit, in particular alternatively to a sealing by the longitudinal sealing unit, and/or to ensure an increased heat input, in particular in a region of the support contour of the form-guiding unit. The heating unit may in particular be realized as a heating coil, as a heating cartridge, as a heating panel, as a thick-film heating element or as another heating unit that is deemed expedient by someone skilled in the art. Preferably the heating unit is arranged at the forming unit and/or at the form-guiding unit, in particular in a direct contact with the forming unit and/or the form-guiding unit. In particular, the horizontal forming device may comprise a plurality of heating units, wherein at least one respective heating unit may be allocated to the forming unit and at least one respective further heating unit may be allocated to the form-guiding unit. In particular, the heating unit is arranged on a side of the forming unit and/or of the form-guiding unit that faces away from a contact surface with the packaging material, in particular the packaging paper. In addition, a heating is conceivable that is arranged parallel to a surface of the forming unit, in particular spaced apart from the forming unit, and which heats the packaging material on an inner side.

In particular, the forming unit and/or the form-guiding unit are/is configured to transfer thermal energy received from the heating unit to the packaging material, in particular the packaging paper. In particular, the forming unit, in particular the forming legs of the forming unit, and/or the form-guiding unit, in particular the forming legs of the form-guiding unit, are/is implemented of a thermally conductive material, in particular of a metal. In particular, the forming unit and/or the form-guiding unit are/is configured, at the contact surface with the packaging material, in particular the packaging paper, to transfer thermal energy provided by the heating unit to the packaging material, in particular in the seam regions. In particular, at least one sealing layer of the packaging paper is activatable by a heat input into the seam regions. Advantageously efficient sealing of the packaging material, in particular the packaging paper, is enabled.

It is moreover proposed that the horizontal forming device comprises at least one air pressure unit, which is configured to exert at the forming unit and/or at the form-guiding unit a negative pressure and/or a positive pressure onto a packaging material. By a "negative pressure" is in particular an air pressure to be understood which is lower than an ambient air pressure of the horizontal forming device. By a "positive pressure" is in particular an air pressure to be understood which is higher than an ambient air pressure of the horizontal forming device. The air pressure unit may in particular be realized as a blower, as an aspirator, or as a different air pressure unit that is deemed expedient by someone skilled in the art. In particular, the horizontal forming device may comprise a plurality of air pressure units, wherein at least one respective air pressure unit is allocated to the forming unit and at least one respective further air pressure unit is allocated to the form-guiding unit. In particular, the air pressure unit is arranged on the side of the forming unit and/or of the form-guiding unit facing away from the contact surface with the packaging material, in particular with the packaging paper. Preferentially the forming unit, in particular the forming legs of the forming unit, and/or the form-guiding unit, in particular the forming legs of the form-guiding unit, are/is realized at least section-wise perforated, in particular of a porous material. In particular, air of an airflow generated by the air pressure unit may flow at least section-wise through the forming unit and/or the form-guiding unit. Preferably the air pressure unit is configured to generate a negative pressure for suctioning the packaging paper to the forming unit and/or to the form-guiding unit, in particular so as to bring about low-crease adjoining of the packaging paper at the forming unit and/or at the form-guiding unit. Preferably the air pressure unit is configured for generating a positive pressure so as to create an air cushion at the forming unit and/or at the form-guiding unit, in particular for implementing low-friction transport of the packaging paper along the forming unit and/or along the form-guiding unit. Preferentially the air pressure unit is switchable between a generation of a negative pressure and a generation of a positive pressure, in particular depending on an application situation, for example depending on a packaging material used. Advantageously a transport of the packaging paper is enabled that is particularly gentle for the material.

Furthermore it is proposed that the horizontal forming device comprises at least one driven contact pressure unit, in particular a contact pressure roller, which is configured to subject a packaging material to a contact pressure force against the form-guiding unit. Preferably the horizontal forming device comprises the at least one driven contact pressure unit alternatively or additionally to an air pressure unit allocated to the form-guiding unit. Preferably the horizontal forming device comprises at least two driven contact pressure units, wherein in each case at least one driven contact pressure unit is allocated to a respective forming leg of the form-guiding unit, and is in particular configured to subject the packaging material to a contact pressure force against the forming leg. In addition, it is conceivable that the horizontal forming device comprises at least one additional driven contact pressure unit, in particular an additional contact pressure roller, which is configured to subject the packaging material to a contact pressure force against the forming unit. Preferably the driven contact pressure units are embodied as contact pressure rollers which are drivable for rotation movements, in particular for a transport of the packaging material tube along the transport direction of the packaging material tube. In particular, the driven contact pressure units are configured to guide the packaging material tube between the driven contact pressure units and the form-guiding unit, in particular the forming legs of the form-guiding unit. Advantageously particularly precise guiding of the packaging material is enabled.

Beyond this the invention is based on a packaging machine, in particular a horizontal flow pack machine, with at least one horizontal forming device according to the invention. Preferably the packaging machine additionally comprises at least the packaging material wind-off unit, the packaging material feeding unit, the product feeding unit, the longitudinal sealing unit and the transversal sealing unit. It is advantageously possible to provide a packaging machine enabling a packaging of products in a manner that is particularly gentle for a material.

The horizontal forming device according to the invention and/or the packaging machine according to the invention shall herein not be limited to the application and implementation described above. In particular, in order to fulfill a functionality that is described here, the horizontal forming device according to the invention and/or the packaging machine according to the invention may comprise a number of individual elements, components and units that differs from a number given here. Moreover, regarding the value ranges given in the present disclosure, values situated within the limits mentioned shall also be considered as disclosed and as applicable according to requirements.

BRIEF DESCRIPTION OF THE DRAWINGS

Further advantages will become apparent from the following description of the drawings. In the drawings four exemplary embodiments of the invention are shown. The drawings, the description and the claims contain a plurality of features in combination. Someone skilled in the art will purposefully also consider the features separately and will find further expedient combinations.

It is Shown in.

DETAILED DESCRIPTION

Figure 1:
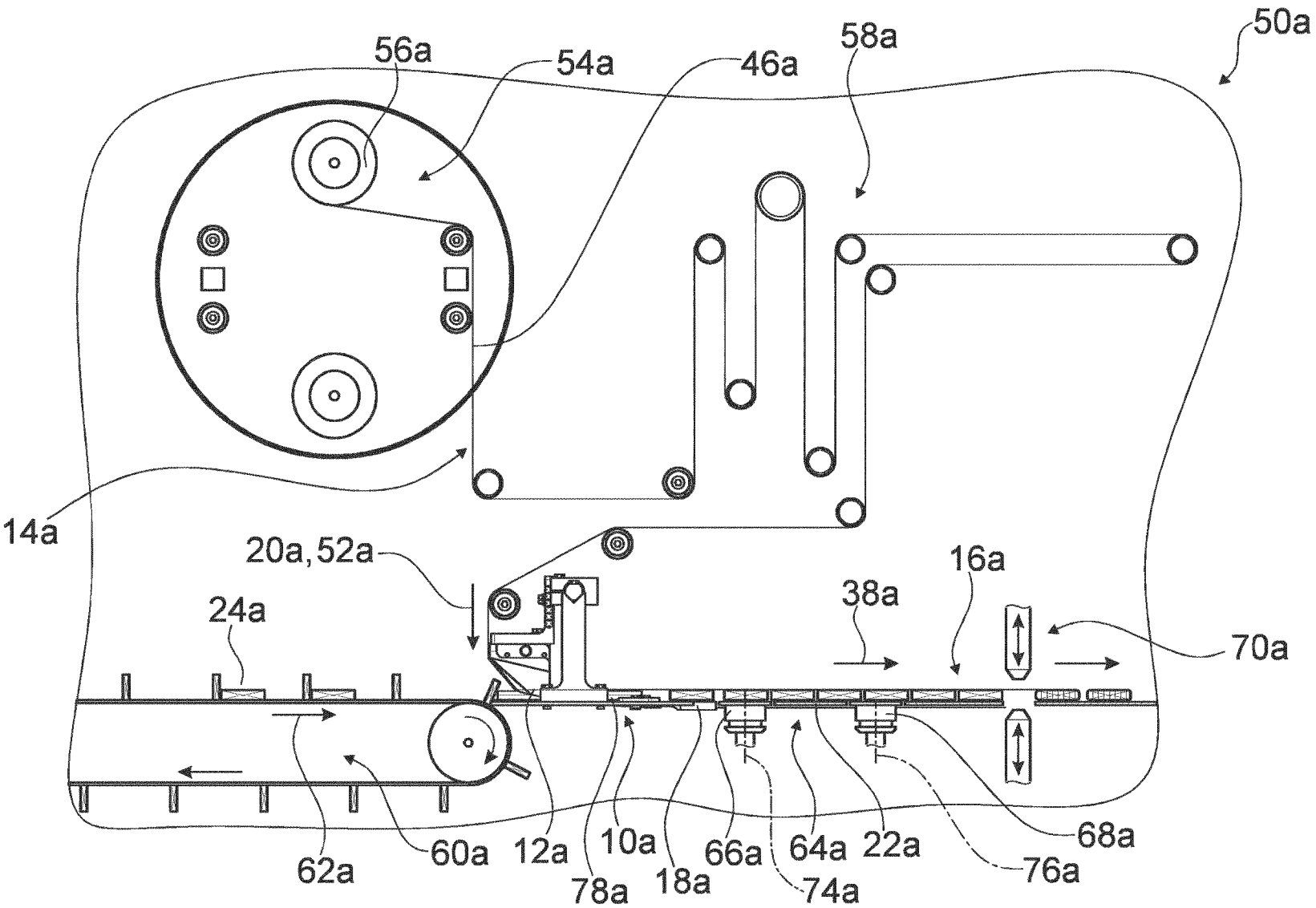
FIG. 1 a portion of a packaging machine according to the invention, in a schematic illustration, FIG. 2 a portion of a horizontal forming device according to the invention of the packaging machine according to the invention of FIG. 1, in a schematic perspective view, FIG. 3 a portion of the packaging machine according to the invention of FIG. 1, in a schematic perspective view, FIG. 4 a portion of the horizontal forming device according to the invention of the packaging machine according to the invention of FIG. 1, in a further schematic perspective view, FIG. 5 a portion of a first alternative horizontal forming device according to the invention, in a schematic perspective view, FIG. 6 a portion of a second alternative horizontal forming device according to the invention, in a schematic perspective view, and FIG. 7 a portion of a third alternative horizontal forming device according to the invention, in a schematic perspective view.

FIG. 1 shows a portion of a packaging machine 50*a* in a schematic illustration. Preferentially the packaging machine 50*a* comprises a horizontal forming device 10*a*, in particular for horizontal flow pack machines, with at least one, in particular roller-free, forming unit 12*a*, in particular a forming shoulder, which is configured for forming a packaging material web 14*a*, in particular a paper web and/or a film web, into a packaging material tube 16*a*. The packaging machine 50*a* is in particular embodied as a horizontal flow pack machine. In particular, the horizontal forming device 10*a* is configured for guiding a packaging material 46*a*, in particular the packaging material tube 16*a*, along a horizontal transport direction 38*a*, in particular along a horizontal transport direction 38*a* that runs at least substantially perpendicularly to an effective gravity force direction 52*a*.

Preferably the horizontal forming device 10*a* is configured at least for a forming and/or guiding of the packaging material web 14*a*, the packaging material 46*a* being preferentially realized as a paper material and/or as a film. In particular, the packaging material web 14*a* is realized as a paper web and/or as a film web. Preferably the horizontal forming device 10*a* may additionally or at least alternatively be configured for a forming and/or guiding of a packaging material web 14*a* wherein the packaging material 46*a* is realized differently from a paper material, for example as a synthetic material. In particular, the packaging material web 14*a* may alternatively be made of a synthetic material. The packaging material 46*a* is in particular configured for a packaging, in particular enveloping, of products 24*a*, in particular of food products (cf. FIG. 3). The packaging material 46*a* is preferentially embodied as a packaging paper. Preferably the packaging machine 50*a* comprises at least one packaging material wind-off unit 54*a*, which is configured to accommodate the packaging material 46*a*, in particular as a packaging material roll 56*a*. Preferably the packaging material wind-off unit 54*a* is configured to unwind the packaging material 46*a* as a packaging material web 14*a*, in particular to feed the packaging material 46*a* to a packaging material feeding unit 58*a* of the packaging machine 50*a*. The packaging material feeding unit 58*a* is in particular configured to feed the packaging material web 14*a* to the horizontal forming device 10*a*, in particular to the forming unit 12*a*. The packaging material feeding unit 58*a* may comprise a plurality of components known to someone skilled in the art, for example at least one oscillating lever, at least one centering feeler, at least one web edge guide control and/or at least one printing unit for printing the packaging material 46*a*.

In particular, the packaging material web 16*a* is configured for enveloping products 24*a* that are to be packaged. In particular, the packaging machine 50*a* comprises at least one product feeding unit 60*a*, in particular a conveyor belt, a driver chain of the like, which is configured to transport the products 24*a* that are to be packaged, for an enveloping by the packaging material tube 16*a*, into a region of the horizontal forming device 10*a*, in particular of the forming unit 12*a*. Preferably a transport direction 62*a* of the products 24*a* runs at least substantially parallel to a transport direction 38*a* of the packaging material tube 16*a*.

The packaging machine 50*a* preferably comprises at least one longitudinal sealing unit 64*a*, which is configured to create—in particular by a pressure onto the packaging material 46*a* and/or by a heat input into the packaging material 46*a*—a longitudinal sealing seam of the packaging material tube 16*a*, which in particular extends at least substantially parallel to the transport direction 38*a* of the packaging material tube 16*a*. The longitudinal sealing unit 64*a* is arranged along the transport direction 38*a* of the packaging material tube 16*a* downstream of the horizontal forming device 10*a*, in particular of a form-guiding unit 18*a* of the horizontal forming device 10*a* (cf. FIG. 2). In particular, the longitudinal sealing unit 64*a* comprises at least one pair of sealing rollers 66*a*, 68*a*, which are in particular heatable, profiled and/or can be subjected to pressure, and which are configured to transport the packaging material tube 16*a*, in particular by a rotation (cf. FIG. 2). Preferably the longitudinal sealing unit 64*a* comprises a plurality of pairs of sealing rollers 66*a*, 68*a*, wherein at least one first pair of sealing rolls 66*a*, which is arranged along the transport direction 38*a* of the packaging material tube 16*a* downstream of the horizontal forming device 10*a*, is implemented free of heating, in particular for a heating-free transport of the packaging material tube 16*a*. Preferably the packaging machine 50*a* comprises at least one transversal sealing unit 70*a* which is configured, in particular after respectively one product 24*a*, to create—in particular by a pressure onto the packaging material 46*a* and/or by a heat input into the packaging material 46*a*—transverse sealing seams of the packaging material tube 16*a*, which in particular extend at least substantially perpendicularly to the transport direction 38*a* of the packaging material tube 16*a*. In particular, the transversal sealing unit 70*a* is configured for singulating the packaging material tube 16*a* so as to form individual packagings, which in particular in each case enclose one product 24*a*. The transversal sealing unit 70*a* is arranged along the transport direction 38*a* of the packaging material tube 16*a* downstream of the longitudinal sealing unit 64*a*. The forming unit 12*a* is preferably configured to deflect the packaging material web 14*a*. In particular, the packaging material feeding unit 58*a* is configured to feed the packaging material web 14*a* to the forming unit 12*a* along a direction, in particular a run-in direction 20*a*, running transversely, in particular at least substantially perpendicularly, to the transport direction 38*a* of the packaging material tube 16*a*.

Figure 2:
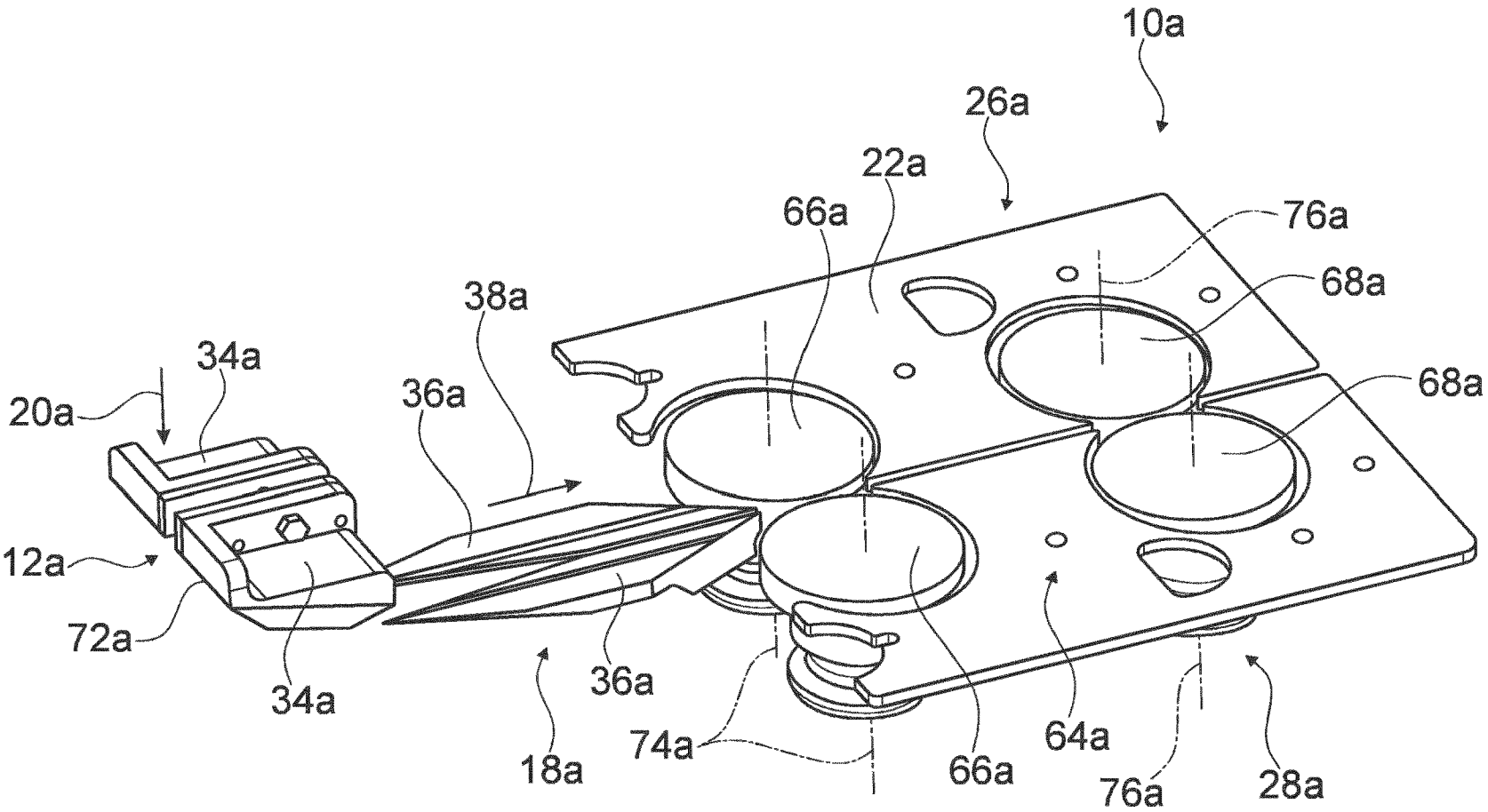

FIG. 2 shows a portion of the horizontal forming device 10*a* of the packaging machine 50*a* of FIG. 1 in a schematic perspective view. Preferentially the horizontal forming device 10*a* comprises at least one form-guiding unit 18*a*, in particular the form-guiding unit 18*a* described above, in particular a further forming shoulder, which is configured for further guiding the packaging material tube 16*a* transversely to a run-in direction, in particular transversely to the run-in direction 20*a* mentioned above, of the packaging material web 14*a* at the forming unit 12*a* while maintaining an, in particular homogeneous, material tension generated by the forming unit 12*a*. The forming unit 12*a* preferably comprises at least one folding edge 72*a*, around which the packaging material web 14*a* can be deflected. Preferably the folding edge 72*a* is embodied as a shoulder edge, and the forming unit 12*a* is embodied as a forming shoulder. In particular, the forming unit 12*a* is realized free of rollers for a deflection of the packaging material web 14*a*. Preferably the forming unit 12*a* is configured to deflect the packaging material web 14*a* at the folding edge 72*a* into a direction that is transverse to the run-in direction 20*a* of the packaging material web 14*a* and transverse to the transport direction 38*a* of the packaging material tube 16*a*. In particular, the folding edge 72*a* extends at least substantially perpendicularly to the run-in direction 20*a* of the packaging material web 14*a* and to the transport direction 38*a* of the packaging material tube 16*a*. In particular, the folding edge 72*a* and/or at least one further folding edge 110*a* of the forming unit 12*a* are/is configured to generate a homogeneous material tension in the packaging material 46*a*.

The form-guiding unit 18*a* is preferentially configured for further guiding the packaging material tube 16*a* at least substantially perpendicularly to the run-in direction 20*a* of the packaging material web 14*a* at the forming unit 12*a*, in particular along the transport direction 38*a* of the packaging material tube 16*a*, while maintaining the homogeneous material tension generated by the forming unit 12*a*, in particular by the folding edge 72*a* and/or by the further folding edge 110*a*. In particular, the form-guiding unit 18*a* is arranged along the transport direction 38*a* of the packaging material tube 16*a* downstream of the forming unit 12*a* and in particular upstream of the longitudinal sealing unit 64*a*. Preferably the form-guiding unit 18*a* is realized free of rollers for a deflection of the packaging material tube 16*a*, and is in particular realized as a further forming shoulder. In particular, the form-guiding unit 18*a* may have a geometry that is at least substantially analogous to a geometry of the forming unit 12*a*.

Preferentially the form-guiding unit 18*a* is realized, in particular arranged, separately from the forming unit 12*a*. Preferably the form-guiding unit 18*a* is implemented as an autonomous component or as an autonomous sub-assembly, and is in particular implemented of two symmetrical components. In particular, the form-guiding unit 18*a* is arranged spaced apart from the forming unit 12*a* along a direction that runs at least substantially perpendicularly to the transport direction 38*a* of the packaging material tube 16*a*, in particular along the run-in direction 20*a* of the packaging material web 14*a*, and/or—in the present exemplary embodiment by way of example and—along the transport direction 38*a* of the packaging material tube 16*a*. Alternatively it is conceivable that the form-guiding unit 18*a* is realized in a one-part implementation with the forming unit 12*a*, in particular as a form-guiding projection of the forming unit 12*a*.

Preferentially the horizontal forming device 10*a* comprises at least one support surface 22*a*, in particular a work plate, on which products 24*a* that are to be packaged can be transported, wherein the forming unit 12*a* and the form-guiding unit 18*a* are arranged on sides 26*a*, 28*a* of the support surface 22*a* that face away from each other. The support surface 22*a* preferably forms a cargo track which the products 24*a* can be transported on. The support surface 22*a* preferably extends at least substantially parallel to the transport direction 38*a* of the packaging material tube 16*a*. Preferably the product feeding unit 60*a*, the longitudinal sealing unit 64*a*, in particular the sealing rollers 66*a*, 68*a*, and/or the transversal sealing unit 70*a* are/is arranged at least section-wise within the support surface 22*a* and extend/extends at least section-wise through the support surface 22*a*. In particular, rotation axes 74*a*, 76*a* of the sealing rollers 66*a*, 68*a* of the longitudinal sealing unit 64*a* extend at least substantially perpendicularly to the support surface 22*a*. Preferably the forming unit 12*a* is arranged on a side 26*a* of the support surface 22*a* on which the products 24*a* can be transported and on which in particular the packaging material winding-off unit 54*a* and the packaging material feeding unit 58*a* are arranged. The form-guiding unit 18*a* is preferably arranged on a further side 28*a* of the support surface 22*a*, on which in particular the longitudinal sealing unit 64*a* is arranged at least largely, in particular by more than 50% of a maximum extent of the longitudinal sealing unit 64*a*, at least substantially parallel to the rotation axes 74*a*, 76*a* of the sealing rollers 66*a*, 68*a*. In particular, the form-guiding unit 18*a* may be at least section-wise coupled with the support surface 22*a*. In particular, the packaging material tube 16*a* extends at least section-wise through the support surface 22*a*, in particular to the further side 28*a* of the support surface 22*a*.

Figure 3:
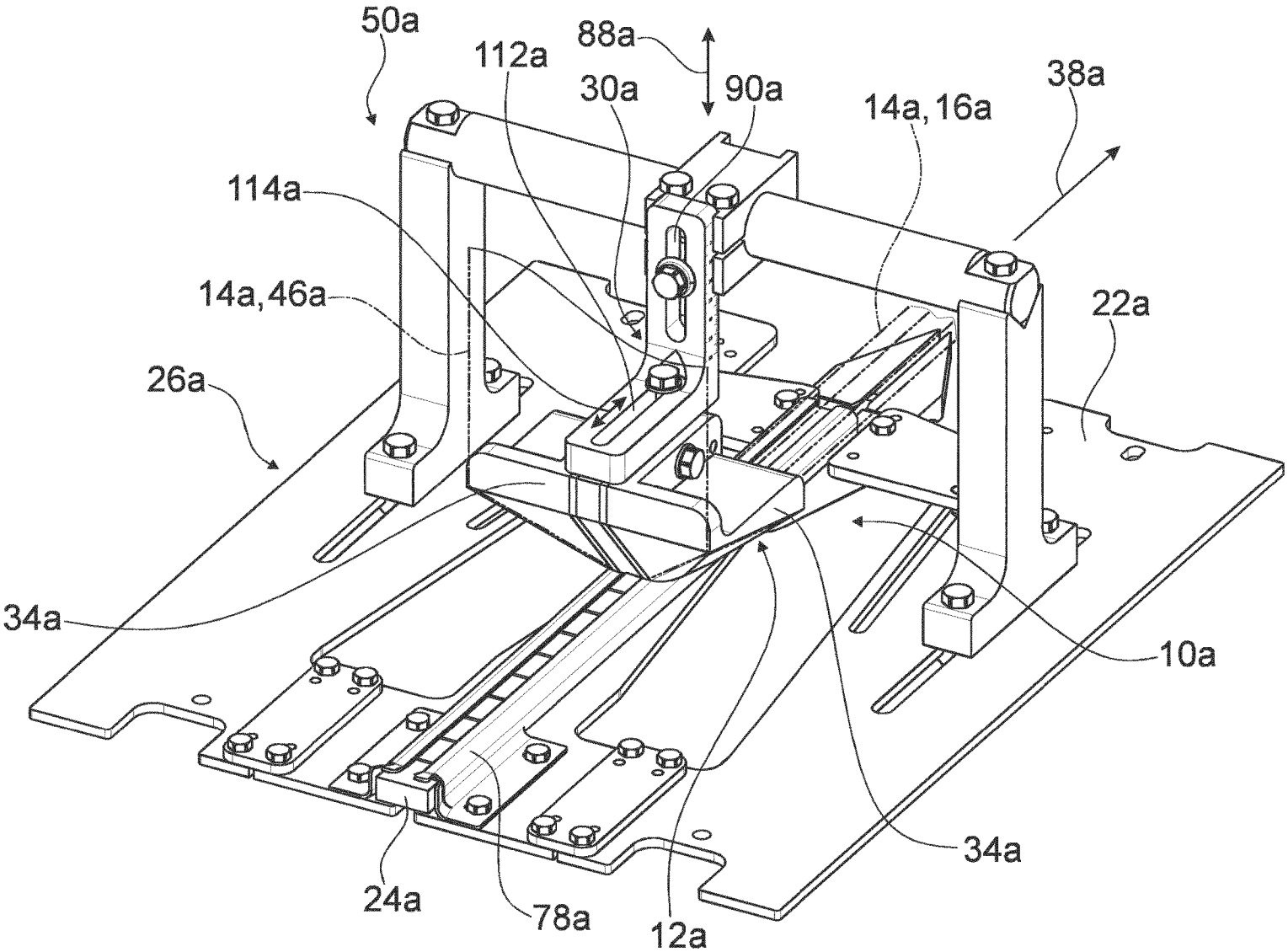

FIG. 3 shows a portion of the packaging machine 50*a* of FIG. 1 in a schematic perspective illustration. Preferentially the horizontal forming device 10*a* comprises at least one, in particular U-shaped, product and/or packaging material guiding tunnel 78*a*, which is configured to support the packaging material tube 16*a*. The product and/or packaging material guiding tunnel 78*a* is in particular arranged on the side 26*a* of the support surface 22*a* that faces toward the forming unit 12*a*, and is in particular fastened at the support surface 22*a*. The product and/or packaging material guiding tunnel 78*a* in particular extends along the transport direction 38*a* of the packaging material tube 18*a* from at least upstream of the forming unit 12*a* as far as the forming unit 12*a*, preferentially as far as the form-guiding unit 18*a* and particularly preferentially as far as the first pair of sealing rollers 66*a* of the longitudinal sealing unit 64*a*. Preferably the product and/or packaging material guiding tunnel 78*a* has a cross section that is at least substantially analogous to a cross section of products 24*a* that are to be packaged, in particular a cross section that is slightly larger than the products 24*a* that are to be packaged. In particular, the products 24*a* can be transported inside the product and/or packaging material guiding tunnel 78*a*. Preferably the forming unit 12*a* is configured to form the packaging material tube 16*a* at least section-wise around the product and/or packaging material tunnel 78*a*, in particular around outer edges of the product and/or packaging material guiding tunnel 78*a*. In particular, the product and/or packaging material guiding tunnel 78*a* is configured to support the packaging material tube 16*a*, in particular in addition to the form-guiding unit 18*a*. Alternatively it is conceivable that the horizontal forming device 10*a* and the packaging machine 50*a* are realized free of the product and/or packaging material guiding tunnel 78*a*.

Figure 4:
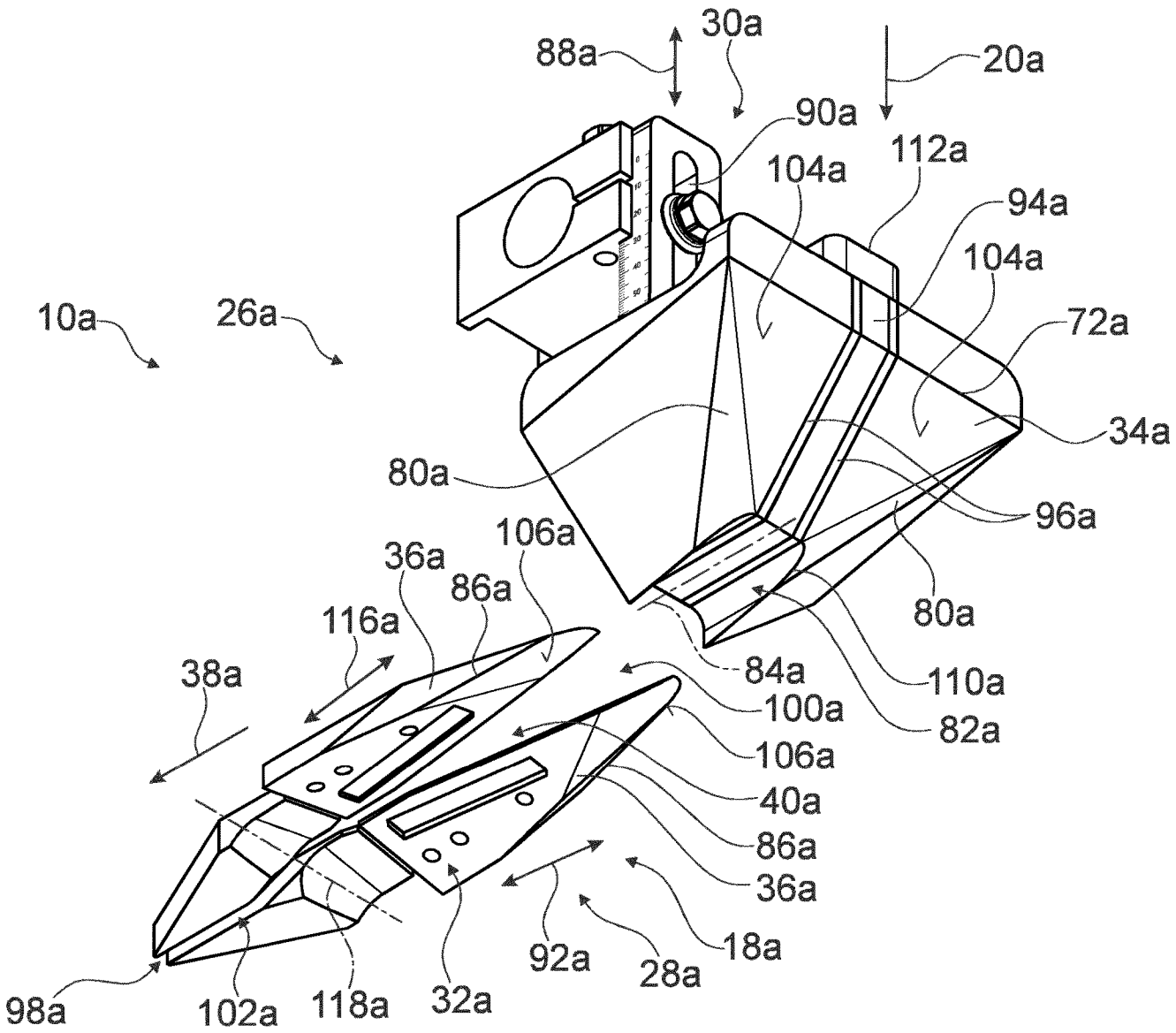

FIG. 4 shows a portion of the horizontal forming device 10*a* of the packaging machine 50*a* of FIG. 1 in a further schematic perspective view. The forming unit 12*a* preferably comprises at least two form-contour edges 80*a* which extend, starting from the folding edge 72*a*, transversely to the folding edge 72*a*, in particular in a V-shape. In particular, the packaging material web 14*a* can be re-formed into the packaging material tube 16*a* around the form-contour edges

80*a* and the further folding edge 110*a*. Preferably the form-contour edges 80*a* extend along a running direction of the of the packaging material 46*a* and/or along an outer contour of the fed-in products 24*a* from the folding edge 72*a* to the further folding edge 110*a*, in particular as far as a forming tunnel 82*a* of the forming unit 12*a*, which is configured to guide the packaging material tube 16*a* along the transport direction 38*a* of the packaging material tube 16*a*. In particular, a longitudinal axis 84*a* of the forming tunnel 82*a* runs at least substantially parallel to the transport direction 38*a* of the packaging material tube 16*a*. Preferably the form-guiding unit 18*a* comprises at least one, in particular three-dimensional, form-guiding contour 86*a*, which is configured to support the guided packaging material tube 16*a*, in particular at least one outer edge of the packaging material tube 16*a*, in particular in order to implement maintenance of the homogeneous material tension. Preferably the form-guiding unit 18*a* comprises at least two form-guiding contours 86*a*, which are in particular arranged mirror-symmetrically around an imaginary symmetry plane extending at least substantially parallel to the transport direction 38*a* of the packaging material tube 16*a* and at least substantially perpendicularly to the folding edge 72*a* of the forming unit 12*a*, the transport direction 38*a* of the packaging material tube 16*a* in particular running in said symmetry plane. Preferably the form-guiding unit 18*a* is realized mirror-symmetrically, in particular around the imaginary symmetry plane. It is alternatively conceivable that the form-guiding unit 18*a* and/or the forming unit 12*a* are/is realized in an asymmetrical manner.

Preferentially the horizontal forming device 10*a* comprises at least one adjusting unit 30*a*, 32*a* which is configured, for an implementation of different packaging material tube geometries, to support the forming unit 12*a* and the form-guiding unit 18*a* in such a way that they are adjustable, in particular in different adjustment planes. Preferably the horizontal forming device 10*a* comprises at least two adjusting units 30*a*, 32*a*, one adjusting unit 30*a* being configured to support the forming unit 12*a* in an adjustable manner and a further adjusting unit 32*a* being configured to support the form-guiding unit 18*a* in an adjustable manner. In particular, different packaging material tube geometries may be required for packaging different products 24*a*. In particular, the packaging machine 50*a* is configured for packaging different products 24*a*, which in particular have different dimensions. In particular, different packaging material tube geometries may be required for a packaging of different products 24*a* having different maximum extents at least substantially perpendicularly to the support surface 22*a*, in particular different heights, and/or having different maximum extents at least substantially parallel to the support surface 22*a* and at least substantially perpendicularly to the transport direction 38*a* of the packaging material tube 16*a*, in particular different widths. In particular, a maximum extent of the packaging material tube 16*a* at least substantially perpendicularly to the support surface 22*a*, in particular a height of the packaging material tube 16*a*, and/or a maximum extent of the packaging material tube 16*a* at least substantially parallel to the support surface 22*a* and at least substantially perpendicularly to the transport direction 38*a* of the packaging material tube 16*a*, in particular a width of the packaging material tube 16*a*, are/is adjustable via an adjustment of the forming unit 12*a* and/or of the form-guiding unit 18*a*. It is in particular possible that the form-guiding unit 18*a* is adjustable via the further adjusting unit 32*a* for a correction of uneven tension conditions in the packaging material 46*a*.

Preferably the forming unit 12*a* is supported so as to be adjustable in at least one adjustment plane extending on the side 26*a* of the support surface 22*a* that faces toward the forming unit 12*a*. Preferably the form-guiding unit 18*a* is supported so as to be adjustable in at least one further adjustment plane extending on the further side 28*a* of the support surface 22*a* that faces toward the form-guiding unit 18*a*. In particular, the forming unit 12*a* and/or the form-guiding unit 18*a* are/is supported so as to be adjustable as an entire component or as an entire sub-assembly. In particular, the forming unit 12*a* and/or the form-guiding unit 18*a* are/is adjustable in themselves/itself, in particular individual components of the forming unit 12*a* and/or individual components of the form-guiding unit 18*a* are/is adjustable relative to one another.

Preferentially the at least one adjusting unit 30*a*, 32*a*, in particular the adjusting units 30*a*, 32*a*, are/is configured to support the forming unit 12*a* and the form-guiding unit 18*a* such that they are adjustable relative to each other. In particular, the adjusting units 30*a*, 32*a* are configured to support the forming unit 12*a* and the form-guiding unit 18*a* such that they are adjustable relative to each other respectively as an entire component or as an entire sub-assembly. Preferably the adjusting units 30*a*, 32*a* are configured to support the forming unit 12*a* and the form-guiding unit 18*a* in a linearly movable and/or pivotably movable manner. Preferably the adjusting unit 30*a* is configured, in particular for an adjustment of a height of the packaging material tube 16*a*, to support the forming unit 12*a* so as to be at least linearly movable along an adjustment direction 88*a* running at least substantially perpendicularly to the support surface 22*a*. In particular, the adjusting unit 30*a* comprises at least one linear guiding 90*a*, which is configured to support the forming unit 12*a* so as to be linearly movable along the adjustment direction 88*a*. In particular, the adjusting unit 30*a* comprises at least one further linear guiding 112*a*, which is configured to support the forming unit 12*a* so as to be linearly movable along a further adjustment direction 114*a* running at least substantially perpendicularly to the adjustment direction 88*a* and at least substantially parallel to the transport direction 38*a* of the packaging material tube 16*a* (cf. FIG. 3). Preferably the further adjusting unit 32*a* is configured to support the form-guiding unit 18*a* so as to be at least linearly movable along at least one adjustment direction 92*a*, 116*a* running at least substantially parallel to the support surface 22*a*, in particular transversely to the transport direction 38*a* of the packaging material tube 16*a*. Preferably the adjusting units 30*a*, 32*a* are realized as manual adjusting units for a manual adjustment of the forming unit 12*a* and the form-guiding unit 18*a*, in particular relative to each other. Alternatively or additionally it is conceivable that at least one of the adjusting units 30*a*, 32*a* comprises at least one automatic adjusting element, in particular a servomotor, which is configured for an automatic adjustment of the forming unit 12*a* and/or of the form-guiding unit 18*a*.

Preferentially the at least one adjusting unit 30*a*, 32*a*, in particular the adjusting units 30*a*, 32*a*, is/are configured to support at least two forming legs 34*a*, 36*a* of the forming unit 12*a* and/or of the form-guiding unit 18*a* such that they are adjustable relative to each other. Preferably the forming unit 12*a* comprises at least two forming legs 34*a*, which are supported in such a way that they are adjustable relative to each other, in particular in a linearly movable and/or pivotably movable manner. In particular, the forming legs 34*a* of the forming unit 12*a* are supported in such a way that they are adjustable relative to each other in an at least linearly movable manner, in particular along a direction running at least substantially parallel to the folding edge 72*a*, in particular to a folding edge running surface. In particular, the adjusting unit 30*a* comprises at least one transverse bearing element 94*a*, which is configured to support the forming legs 34*a* of the forming unit 12*a* relative to each other in an at least linearly movable manner. In particular, the forming legs 34*a* of the forming unit 12*a* together form the folding edge 72*a*, in particular the folding edge running surface. In particular, for an adjustment of a width of the packaging material tube 16*a*, the forming legs 34*a* of the forming unit 12*a* are in particular supported so as to be movable toward each other and away from each other, in particular along the direction running at least substantially parallel to the folding edge 72*a*. In particular, the forming legs 34*a* of the forming unit 12*a* together form the forming tunnel 82*a* of the forming unit 12*a*. In particular, respectively one forming leg 34*a* of the forming unit 12*a* in each case forms at least one form-contour edge 80*a* of the forming unit 12*a*. In particular in order to ensure different product widths, the adjusting unit 30*a* preferably comprises at least one intermediate element 96*a*, in particular a plurality of intermediate elements 96*a*, for filling a space between two forming legs 34*a* of the forming unit 12*a* which have been moved away from each other.

Preferably the form-guiding unit 18*a* comprises at least two forming legs 36*a*, which are supported in such a way that they are adjustable relative to each other, in particular in a linearly movable and/or pivotably movable manner. In particular, the further adjusting unit 32*a*, which is configured for an adjustable support of the form-guiding unit 18*a*, may in an alternative implementation be realized at least substantially analogously to the adjusting unit 30*a* that is configured for an adjustable support of the forming unit 12*a*. Preferably the forming legs 36*a* of the form-guiding unit 18*a* are supported such that they are adjustable relative to each other at least in a linearly movable manner. In particular, the further adjusting unit 32*a* is configured to support the forming legs 36*a* of the form-guiding unit 18*a* so as to be adjustable in a linearly movable manner along different adjustment directions 92*a*, 116*a*, which in particular run transversely to one another, in particular in order to ensure different product widths. Preferably the adjustment directions 92*a*, 116*a* run in a shared plane, which in particular extends at least substantially parallel to the support surface 22*a*, and in particular include identical angles with the transport direction 38*a* of the packaging material tube 16*a*. Alternatively or additionally the forming legs 36*a* of the form-guiding unit 18*a* may be supported adjustably relative to each other, in particular such that they are at least pivotably movable in particular in a pivoting plane extending at least substantially parallel to the support surface 22*a*, in particular for an adjustment of the width of the packaging material tube 16*a*. In particular, in an alternative implementation the forming legs 36*a* of the form-guiding unit 18*a* may be supported in a pivotably movable manner at an end region 98*a* of the forming legs 36*a* of the form-guiding unit 18*a*, which faces away from the forming unit 12*a* along the transport direction 38*a* of the packaging material tube 16*a*. Preferably, in an alternative implementation the end region 98*a* of the forming legs 36*a* of the form-guiding unit 18*a* may be realized, in particular mounted, separately from a remaining region of the form-guiding unit 18*a*, in particular separately from the remaining region along a separating cut 118*a*. In particular, respectively one forming leg 36*a* of the form-guiding unit 18*a* in each case forms at least one form-guiding contour 86*a* of the form-guiding unit 18*a*. Preferably the forming legs 36*a* of the form-guiding unit 18*a* are arranged, in particular supported, mirror-symmetrically around the imaginary symmetry plane.

Preferentially the forming legs 36*a* of the form-guiding unit 18*a* form a guiding region 40*a*, which tapers in a V-shape in the transport direction 38*a* of the packaging material tube 16*a* and which is configured to bring seam regions of the packaging material tube 16*a* together, which are to be sealed with each other. In particular, the guiding region 40*a* is configured to bring longitudinal sealing seam regions of the packaging material tube 16*a* together, which are to be sealed with each other. In particular, the forming legs 36*a* of the form-guiding unit 18*a* have, in an end region 100*a* facing toward the forming unit 12*a*, a greater distance from each other along a direction running at least substantially parallel to the support surface 22*a* and at least substantially perpendicularly to the transport direction 38*a* of the packaging material tube 16*a* than in the end region 98*a* that faces away from the forming unit 12*a*. The seam regions of the packaging material tube 16*a* are in particular regions in which the packaging material 46*a*, in particular the packaging paper, is sealed, in particular for the purpose of creating a sealing seam. In particular, the guiding region 40*a* is configured to bring the seam regions together in such a way that for a sealing the seam regions can be transported, adjoining each other, between and through respectively two sealing rollers 66*a*, 68*a* of the pairs of sealing rollers 66*a*, 68*a*. Preferably, in the end region 98*a* facing away from the forming unit 18*a*, the guiding region 40*a* ends in a supporting contour 102*a* that is formed by the forming legs 36*a* of the form-guiding unit 18*a* and is configured, in particular during a further transport as far as the longitudinal sealing unit 64*a*, to support the packaging material tube 16*a*, in particular the seam regions which have been brought together.

Figure 5:
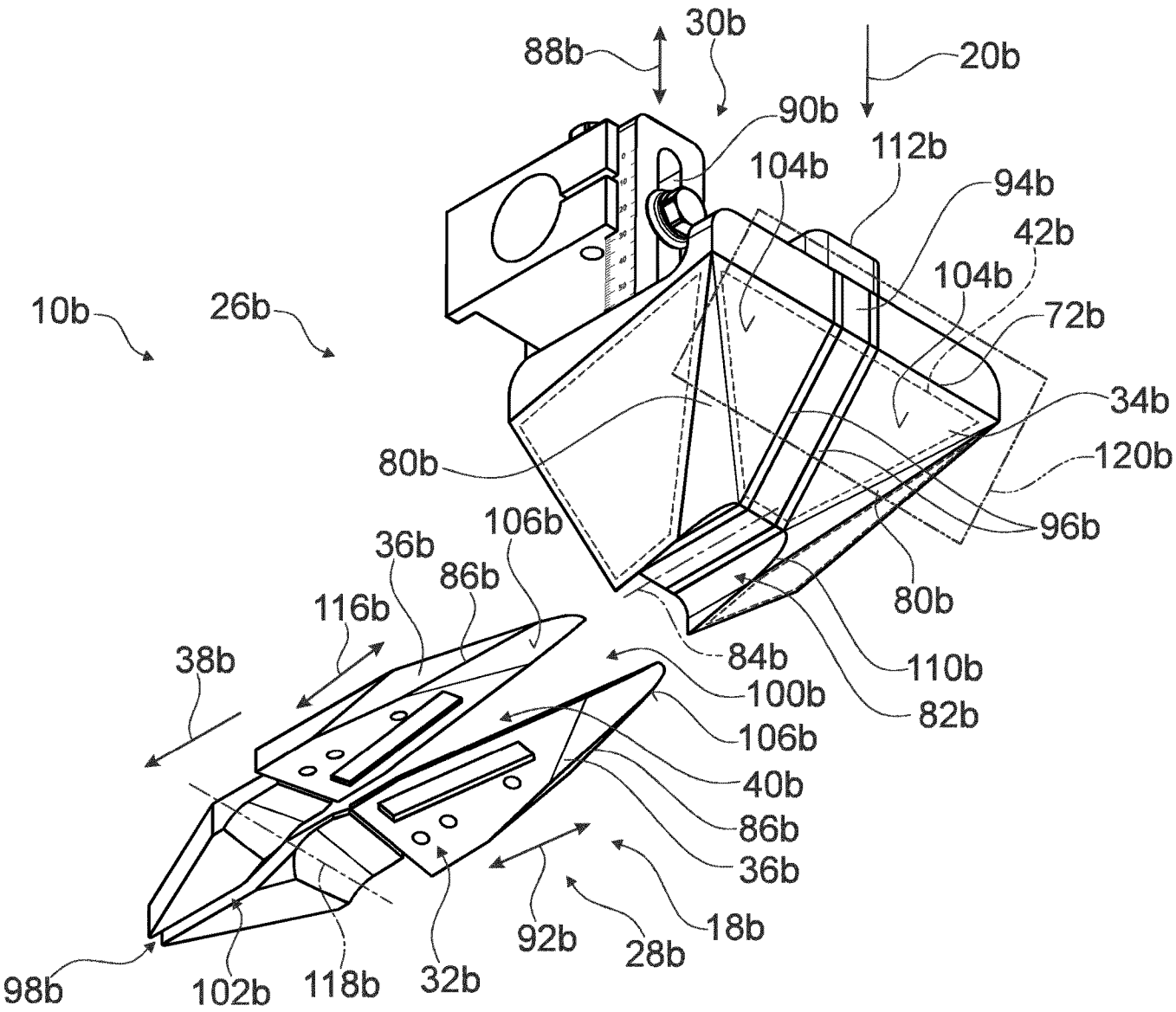
Figure 6:
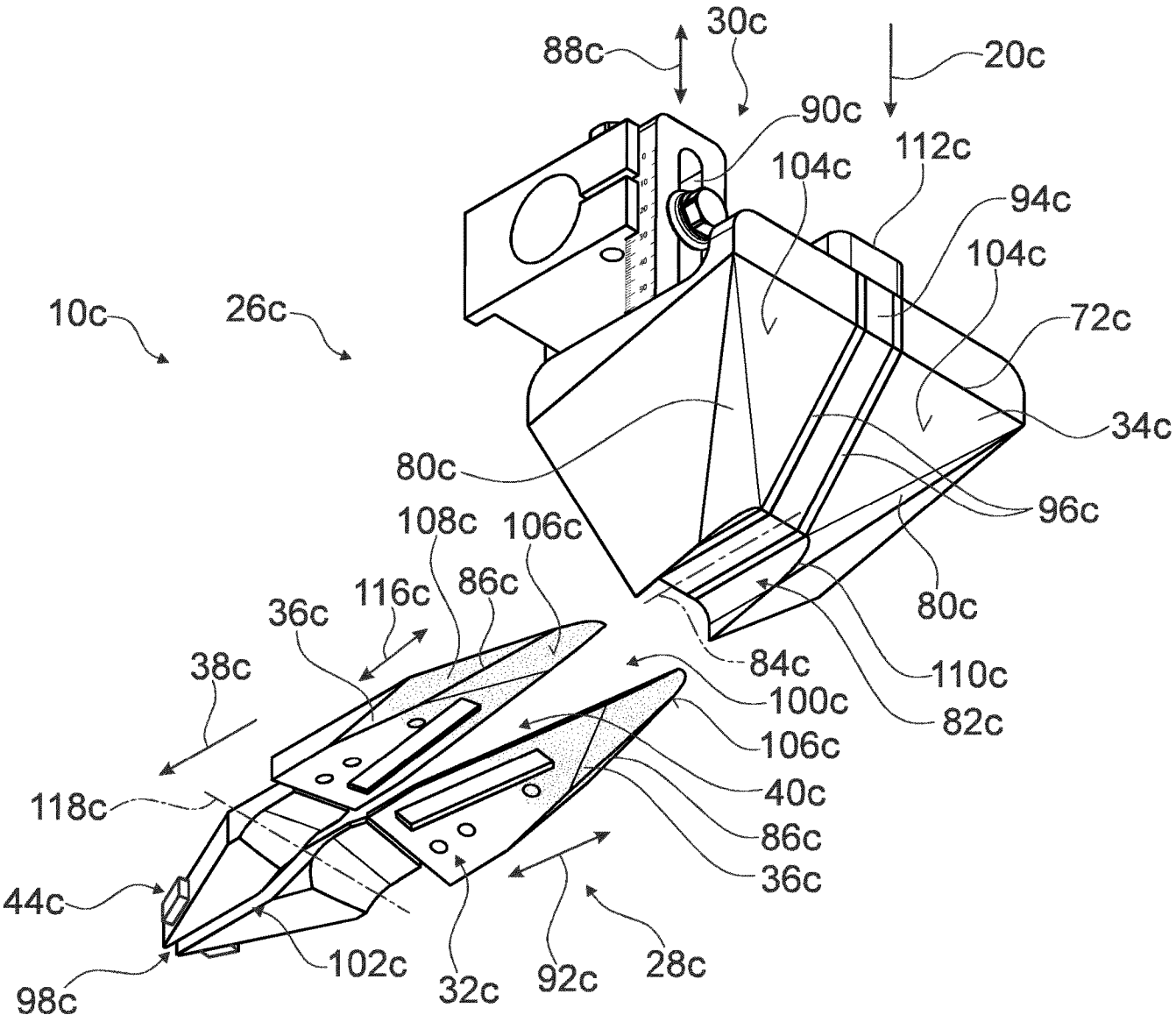
Figure 7:
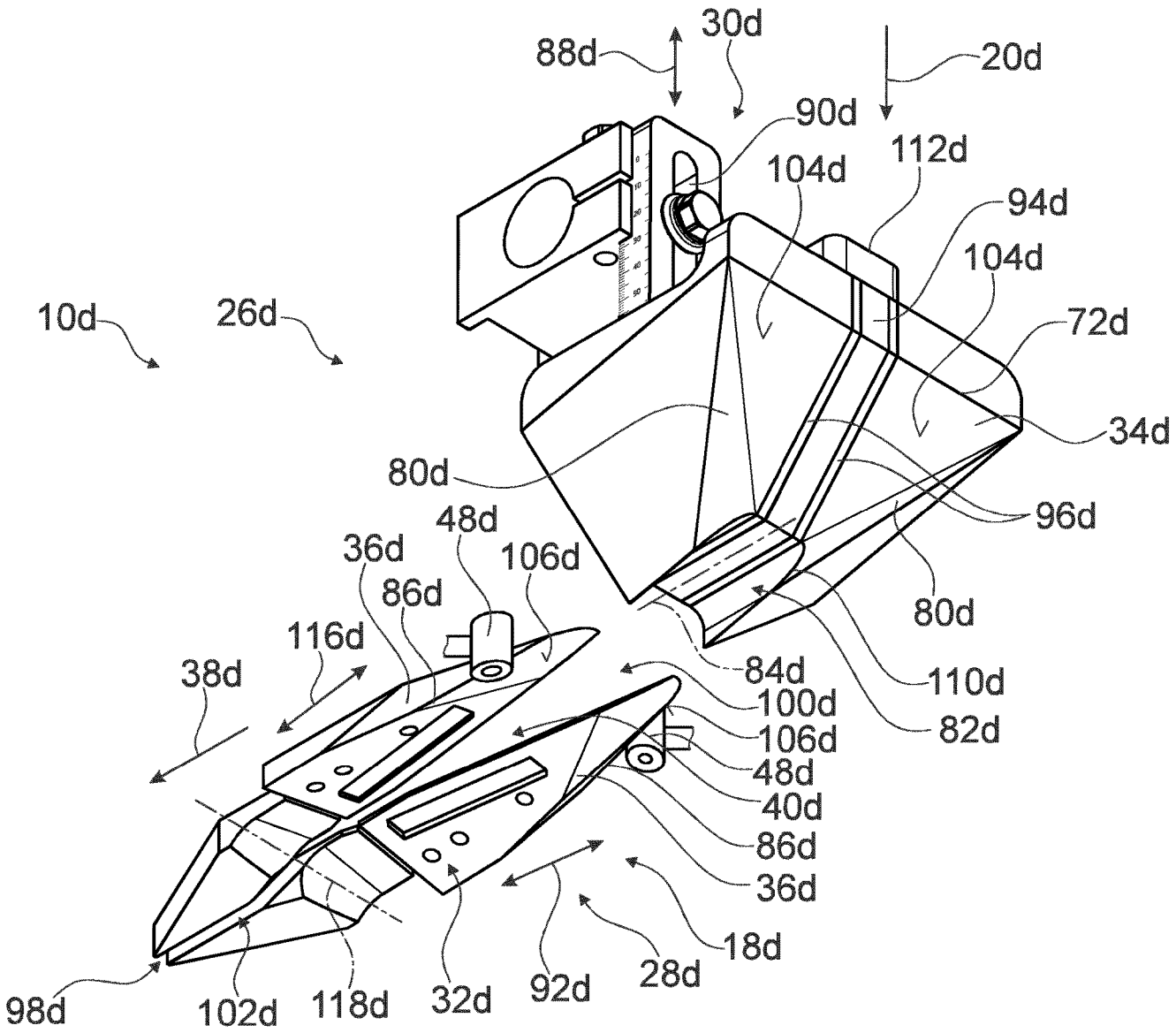

In FIGS. 5 to 7 three further exemplary embodiments of the invention are shown. The following descriptions and the drawings are limited essentially to the differences between the exemplary embodiments, wherein regarding components having the same denomination, in particular regarding components having the same reference numerals, principally the drawings and/or the description of the other exemplary embodiments, in particular of FIGS. 1 to 4, may be referred to. In order to distinguish between the exemplary embodiments, the letter a has been added to the reference numerals of the exemplary embodiment of FIGS. 1 to 4. In the exemplary embodiments of FIGS. 5 to 7 the letter a has been substituted by the letters b to d.

FIG. 5 shows a portion of a first alternative horizontal forming device 10*b* in a schematic perspective view. The horizontal forming device 10*b* in particular comprises at least one forming unit 12*b* and at least one form-guiding unit 18*b*. Preferentially the horizontal forming device 10*b* comprises at least one heating unit 42*b*, which is configured for heating the forming unit 12*b* and/or the form-guiding unit 18*b* at least section-wise, in particular for a heat input into a seam region, in particular a seam region of a packaging material. In particular, the heating unit 42*b* is configured to enable a heat input upstream of a sealing, in particular a longitudinal sealing, of the packaging material, in particular of a packaging paper, into the packaging material, in particular into the packaging paper. Alternatively or additionally it is conceivable that the heating unit 42*b* is configured—in particular as an alternative to a sealing by a longitudinal sealing unit of a packaging machine—for sealing the packaging material, in particular the packaging paper, in particular at the form-guiding unit 18*b*, and/or to ensure an increased heat input, in particular in a region of a supporting contour 102*b* of the form-guiding unit 18*b*. The heating unit 42*b* may in particular be embodied as a heating coil, as a heating cartridge, as a heating panel, as a thick-film heating element or as a different heating unit deemed expedient by someone skilled in the art. Preferably the heating unit 42*b* is arranged at the forming unit 12*b* and/or at the form-guiding unit 18*b*, and is in particular in a direct contact with the forming unit 12*b* and/or the form-guiding unit 18*b*. In particular, the horizontal forming device 10*b* may comprise a plurality of heating units 42*b*, wherein in each case at least one respective heating unit 42*b* may be assigned to the forming unit 12*b* and at least one respective heating unit 42*b* may be assigned to the form-guiding unit 18*b*. In particular, the heating unit 42*b* is arranged on a side of the forming unit 12*b* and/or of the form-guiding unit 18*b* that faces away from a contact surface 104*b* with the packaging material, in particular the packaging paper. In the present exemplary embodiment the horizontal forming device 10*b* exemplarily comprises a single heating unit 42*b*, which is arranged at the forming unit 12*b*, in particular on the side of the forming unit 12*b* facing away from the contact surface 104*b* with the packaging material, and which is in particular in a direct contact with the forming unit 12*b*. In addition, a heating is conceivable which is arranged parallel to a surface 120*b* of the forming unit 12*b*, and is in particular spaced apart from the form-guiding unit 18*b*, and which heats the packaging material on an inner side.

In particular, the forming unit 12*b* and/or the form-guiding unit 18*b*, in the present exemplary embodiment by way of example the forming unit 12*b*, are/is configured to transfer thermal energy received from the heating unit 42*b* to the packaging material, in particular the packaging paper. In particular, the forming unit 12*b*, in particular the forming legs 34*b* of the forming unit 12*b*, and/or the form-guiding unit 18*b*, in particular the forming legs 36*b* of the form-guiding unit 18*b*, in the present exemplary embodiment exemplarily at least the forming unit 12*b*, are/is formed of a thermally conductive material, in particular of a metal. In particular, the forming unit 12*b* and/or the form-guiding unit 18*b*, in the present exemplary embodiment exemplarily the forming unit 12*b*, are/is configured, at the contact surface 104*b* with the packaging material, in particular the packaging paper, to transfer a thermal energy provided by the heating unit 42*b* to the packaging material, in particular in the seam regions. In particular, at least one sealing layer of the packaging paper can be activated by a heat input into the seam regions.

FIG. 6 shows a portion of a second alternative horizontal forming device 10*c* in a schematic perspective view. The horizontal forming device 10*c* in particular comprises at least one forming unit 12*c* and at least one form-guiding unit 18*c*. Preferentially the horizontal forming device 10*c* comprises at least one air pressure unit 44*c* which is configured, at the forming unit 12*c* and/or at the form-guiding unit 18*c*, to exert a negative pressure and/or a positive pressure onto a packaging material. In the present exemplary embodiment, the horizontal forming device 10*c* comprises by way of example two air pressure units 44*c*, wherein respectively one of the air pressure units 44*c* is configured to exert a negative pressure and/or a positive pressure at a respective forming leg 36*c* of the forming unit 12*c*. The air pressure units 44*c* may be realized in particular as a blower, as a suction device, or as other air pressure units deemed expedient by someone skilled in the art. In particular, in an alternative implementation the horizontal forming device 10*c* may comprise a plurality of air pressure units 44*c*, wherein in each case at least one air pressure unit 44*c* may be assigned to the forming unit 12*c* and in each case at least one further air pressure unit 44*c* may be assigned to the form-guiding unit 18*c*. In particular, the air pressure units 44*c* are arranged on a side of the forming unit 12*c* and/or of the form-guiding unit 18*c*, in the present exemplary embodiment exemplarily of the form-guiding unit 18*c*, that faces away from a contact surface 106*c* with the packaging material, in particular the packaging paper. Preferentially, the forming unit 12*c*, in particular the forming legs 34*c* of the forming unit 12*c*, and/or the form-guiding unit 18*c*, in particular the forming legs 36*c* of the form-guiding unit 18*c*, in the present exemplary embodiment exemplarily the form-guiding unit 18*c*, are/is implemented so as to be at least section-wise perforated, in particular implemented of a porous material. In particular, the forming legs 36*c* of the form-guiding unit 18*c* have a perforation 108*c*. In particular, air of an airflow generated by the air pressure units 44*c* can flow at least section-wise through the forming unit 12*c* and/or the form-guiding unit 18*c*, in the present exemplarily embodiment exemplarily through the form-guiding unit 18*c*. Preferably the air pressure units 44*c* are configured to generate a negative pressure for suctioning the packaging paper to the forming unit 12*c* and/or to the form-guiding unit 18*c*, in the present exemplary embodiment exemplarily to the form-guiding unit 18*c*, in particular for an implementation of a low-wrinkle adjoining of the packaging paper at the forming unit 12*c* and/or at the form-guiding unit 18*c*, in the present exemplary embodiment exemplarily at the form-guiding unit 18*c*. Preferably the air pressure units 44*c* are configured to generate a positive pressure for the purpose of forming an air cushion at the forming unit 12*c* and/or at the form-guiding unit 18*c*, in the present exemplary embodiment by way of example at the form-guiding unit 18*c*, in particular for the purpose of realizing a low-friction transport of the packaging paper along the forming unit 12*c* and/or the form-guiding unit 18*c*, in the present exemplary embodiment by way of example along the form-guiding unit 18*c*. Preferentially the air pressure units 44*c* are switchable between a generation of a negative pressure and a generation of a positive pressure, in particular depending on an application situation, for example depending on a packaging material used.

FIG. 7 shows a portion of a third alternative horizontal forming device 10*d* in a schematic perspective view. The horizontal forming device 10*d* comprises at least one forming unit 12*d* and at least one form-guiding unit 18*d*. Preferentially the horizontal forming device 10*d* comprises at least one driven contact pressure unit 48*d*, in particular a contact pressure roller, which is configured to subject a packaging material to a contact pressure force against the form-guiding unit 18*c*. Preferably the horizontal forming device 10*d* comprises the at least one driven contact pressure unit 48*d* alternatively or additionally, in the present exemplary embodiment by way of example alternatively, to an air pressure unit assigned to the form-guiding unit 18*d*. Preferably the horizontal forming device 10*d* comprises at least two driven contact pressure units 48*d*, wherein in each case at least one driven contact pressure unit 48*d* is assigned to a respective forming leg 36*d* of the form-guiding unit 18*d*, and is in particular configured to subject the packaging material to a contact pressure force against the forming leg 36*d*. It is in addition conceivable that the horizontal forming device 10*d* comprises at least one additional driven contact pressure unit 48*d*, in particular an additional contact pressure roller, which is configured to subject the packaging material to a contact pressure force against the forming unit 12*d*. Preferably the driven contact pressure units 48*d* are realized as contact pressure rollers which are driven to execute rotation movements, in particular for a transport of a packaging material tube along a transport direction 38*d* of the packaging material tube. In particular, the driven contact pressure units 48*d* are configured to guide the packaging material tube between the driven contact pressure units 48*d* and the form-guiding unit 18*d*, in particular the forming legs 36*d* of the form-guiding unit 18*d*.

What is claimed is:

1. A horizontal forming device, the horizontal forming device comprising:

at least one forming unit (12*a*-12*d*), which is configured for forming a packaging material web (14*a*) into a packaging material tube (16*a*), the at least one forming unit (12*a*-12*d*) comprising at least one folding edge (72*a*-72*d*) around which the packaging material web (14*a*) is deflectable, at least one form-guiding unit (18*a*-18*d*), which is configured for further guiding the packaging material tube (16*a*) transversely to a run-in direction (20*a*-20*d*) of the packaging material web (14*a*) at the at least one forming unit (12*a*-12*d*) while maintaining a material tension generated by the at least one forming unit (12*a*-12*d*), at least one support surface (22*a*), on which products (24*a*) that are to be packaged can be transported, the at least one forming unit (12*a*-12*d*) and the at least one form-guiding unit (18*a*-18*d*) being arranged on sides (26*a*-26*d*, 28*a*-28*d*) of the support surface (22*a*) that face away from each other, and at least one adjusting unit (30*a*-30*d*, 32*a*-32*d*), wherein the at least one form-guiding unit (18*a*-18*d*) comprises at least one form-guiding contour (86*a*-86*d*), which is configured to support the guided packaging material tube (16*a*) in order to implement a maintaining of the material tension, wherein the at least one adjusting unit (30*a*-30*d*, 32*a*-32*d*) is configured to support the at least one forming unit (12*a*-12*d*) and the at least one form-guiding unit (18*a*-18*d*) such that the at least one forming unit (12*a*-12*d*) and the at least one form-guiding unit (18*a*-18*d*) are adjustable relative to each other, wherein the at least one forming unit (12*a*-12*d*), the at least one form-guiding unit (18*a*-18*d*) or both are movably supported.

2. The horizontal forming device according to claim 1, wherein the at least one form-guiding unit (18*a*-18*d*) is realized separately from the at least one forming unit (12*a*-12*d*).

3. The horizontal forming device according to claim 1, comprising at least one product and/or packaging material guiding tunnel (78*a*), which is configured to support the packaging material tube (16*a*).

4. The horizontal forming device according to claim 1, wherein the at least one adjusting unit (30*a*-30*d*, 32*a*-32*d*) is configured to support at least two forming legs (34*a*-34*d*, 36*a*-36*d*) of the at least one forming unit (12*a*-12*d*) and/or of the at least one form-guiding unit (18*a*-18*d*) such that the at least one forming unit (12*a*-12*d*) and the at least one form-guiding unit (18*a*-18*d*) are adjustable relative to one another.

5. The horizontal forming device according to claim 1, wherein the at least one adjusting unit (30*a*-30*d*, 32*a*-32*d*) is configured to support at least two forming legs (34*a*-34*d*, 36*a*-36*d*) of the at least one forming unit (12*a*-12*d*) and/or of the at least one form-guiding unit (18*a*-18*d*) such that the at least one forming unit (12*a*-12*d*) and the at least one form-guiding unit (18*a*-18*d*) are adjustable relative to one another, and wherein the forming legs (36*a*-36*d*) of the at least one form-guiding unit (18*a*-18*d*) form a guiding region (40*a*-40*d*), which tapers in a V-shape in a transport direction (38*a*-38*d*) of the packaging material tube (16*a*) and is configured to bring seam regions of the packaging material tube (16*a*) together which are to be sealed with each other.

6. The horizontal forming device according to claim 1, comprising at least one heating unit (42*b*), which is configured to at least section-wise heat the at least one forming unit (12*b*) and/or the at least one form-guiding unit (18*b*).

7. The horizontal forming device according to claim 1, comprising at least one air pressure unit (44*c*), which is configured to exert at the at least one forming unit (12*c*) and/or at the at least one form-guiding unit (18*c*) a negative pressure and/or a positive pressure onto a packaging material.

8. The horizontal forming device according to claim 1, comprising at least one driven contact pressure unit (48*d*), which is configured to subject a packaging material with a contact pressure force against the at least one form-guiding unit (18*d*).

9. The horizontal forming device according to claim 1, wherein the at least one forming unit (12*a*-12*d*) is embodied as a forming shoulder and the at least one form-guiding unit (18*a*-18*d*) is embodied as a further forming shoulder.

10. The horizontal forming device according to claim 9, wherein the at least one form-guiding unit (18*a*-18*d*) comprises at least two forming legs (36*a*-36*d*), which are supported such that the at least two forming legs (36*a*-36*d*) are adjustable relative to each other.

11. The horizontal forming device according to claim 3, wherein the at least one form-guiding unit (18*a*-18*d*) comprises at least two forming legs (36*a*-36*d*), which are supported such that the at least two forming legs (36*a*-36*d*) are adjustable relative to each other.

12. A packaging machine with at least one horizontal forming device according to claim 1.

13. The packaging machine according to claim 12, wherein the packaging machine is embodied as a horizontal flow pack machine.

14. The horizontal forming device according to claim 1, wherein the at least one forming unit (12*a*-12*d*) is roller-free.

15. The horizontal forming device according to claim 1, wherein the at least one forming unit (12*a*-12*d*) is a forming shoulder.

16. The horizontal forming device according to claim 1, wherein the packaging material web (14*a*) is a paper web.

17. The horizontal forming device according to claim 1, wherein the material tension generated by the at least one forming unit (12*a*-12*d*) is homogeneous.

18. The horizontal forming device according to claim 1, wherein the at least one forming unit (12*a*-12*d*) is arranged on a side (26*a*-26*d*) of the support surface (22*a*), on which the products (24*a*) can be transported and on which a packaging material wind-off unit (54*a*) and a packaging material feeding unit (58*a*) are arranged, and wherein the at least one form-guiding unit (18*a*-18*d*) is arranged on a further side (28*a*-28*d*) of the support surface (22*a*), on which a longitudinal sealing unit (64*a*) is arranged.

19. A horizontal forming device, the horizontal forming device comprising:

at least one forming unit (12*a*-12*d*), which is configured for forming a packaging material web (14*a*) into a packaging material tube (16*a*), the at least one forming unit (12*a*-12*d*) comprising at least one folding edge (72*a*-72*d*) around which the packaging material web (14*a*) is deflectable, at least one form-guiding unit (18*a*-18*d*), which is configured for further guiding the packaging material tube (16*a*) transversely to a run-in direction (20*a*-20*d*) of the packaging material web (14*a*) at the at least one forming unit (12*a*-12*d*) while maintaining a material tension generated by the at least one forming unit (12*a*-12*d*), at least one support surface (22*a*), on which products (24*a*) that are to be packaged can be transported, the at least one forming unit (12*a*-12*d*) and the at least one form-guiding unit (18*a*-18*d*) being arranged on sides (26*a*-26*d*, 28*a*-28*d*) of the support surface (22*a*) that face away from each other, and at least one adjusting unit (30*a*-30*d*, 32*a*-32*d*), wherein the at least one forming unit (12*a*-12*d*) is arranged on an upper side of the at least one support surface (22*a*) and the at least one form-guiding unit (18*a*-18*d*) is arranged on an underside of the at least one support surface (22*a*), wherein the at least one form-guiding unit (18*a*-18*d*) comprises at least one form guiding contour (86*a*-86*d*), which is configured to support the guided packaging material tube (16*a*) in order to implement a maintaining of the material tension, wherein the at least one forming unit (12*a*-12*d*) is roller-free, wherein the at least one adjusting unit (30*a*-30*d*, 32*a*-32*d*) is configured to support the at least one forming unit (12*a*-12*d*) and the at least one form-guiding unit (18*a*-18*d*) such that the at least one forming unit (12*a*-12*d*) and the at least one form-guiding unit (18*a*-18*d*) are adjustable relative to each other, wherein the at least one forming unit (12*a*-12*d*), the at least one form-guiding unit (18*a*-18*d*) or both are movably supported.

20. The horizontal forming device according to claim 19, wherein the at least one forming unit (12*a*-12*d*) is arranged on a side (26*a*-26*d*) of the support surface (22*a*), on which the products (24*a*) can be transported and on which a packaging material wind-off unit (54*a*) and a packaging material feeding unit (58*a*) are arranged, and wherein the at least one form-guiding unit (18*a*-18*d*) is arranged on a further side (28*a*-28*d*) of the support surface (22*a*), on which a longitudinal sealing unit (64*a*) is arranged.

* * * * *